US012570449B2

(12) United States Patent
Kim

(10) Patent No.: US 12,570,449 B2
(45) **Date of Patent: *Mar. 10, 2026**

(54) CLOSURE WITH HINGE

(71) Applicant: Silgan White Cap LLC, Downers Grove, IL (US)

(72) Inventor: Sungsuk Steve Kim, Batavia, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 84 days.

This patent is subject to a terminal disclaimer.

(21) Appl. No.: 18/480,883

(22) Filed: Oct. 4, 2023

(65) Prior Publication Data

US 2024/0025608 A1 Jan. 25, 2024

Related U.S. Application Data

(63) Continuation of application No. 17/086,951, filed on Nov. 2, 2020, now Pat. No. 11,814,224, which is a (Continued)

(51) Int. Cl.
*B65D 55/16* (2006.01)
*B65D 41/04* (2006.01)
(Continued)

(52) U.S. Cl.
CPC ..... *B65D 55/16* (2013.01); *B65D 41/0414* (2013.01); *B65D 41/3428* (2013.01);
(Continued)

(58) Field of Classification Search
CPC ..... B65D 55/16; B65D 41/0414; B65D 41/3428; B65D 41/3447; B65D 43/169;
(Continued)

(56) References Cited

U.S. PATENT DOCUMENTS 3,904,062 A 9/1975 Grussen
4,394,918 A 7/1983 Grussen
(Continued)

FOREIGN PATENT DOCUMENTS

CN 1631740 6/2005
CN 1631741 6/2005
(Continued)

OTHER PUBLICATIONS

International Searching Authority, "International Search Report and Written Opinion," issued in connection with International Application No. PCT/US2019/021139, mailed on Jun. 19, 2019, 13 pages.
(Continued)

*Primary Examiner* — James N Smalley
(74) *Attorney, Agent, or Firm* — Reinhart Boerner Van Deuren s.c.

(57) ABSTRACT

A closure that remains coupled to a container after the upper portion of the closure has been rotatably removed from the container. The closure may include an attachment channel, which includes alternating segments of linear openings and frangible connections. The attachment channel may also include two hinge bridges that remain unbroken when one or more of the frangible connections are broken.

15 Claims, 7 Drawing Sheets

Related U.S. Application Data continuation of application No. 15/974,871, filed on May 9, 2018, now Pat. No. 10,836,544.

(51) Int. Cl.
*B65D 41/34* (2006.01)
*B65D 43/16* (2006.01)

(52) U.S. Cl.
CPC ..... *B65D 41/3447* (2013.01); *B65D 43/169* (2013.01); *B65D 2251/023* (2013.01); *B65D 2251/10* (2013.01); *B65D 2251/1008* (2013.01); *B65D 2401/30* (2020.05)

(58) Field of Classification Search
CPC ..... B65D 2251/023; B65D 2251/10; B65D 2251/1008; B65D 2401/30; B65D 41/48
See application file for complete search history.

(56) References Cited

U.S. PATENT DOCUMENTS

| | | | |
|---|---|---|---|
| 4,557,393 | A | 12/1985 | Boik |
| 4,565,293 | A | 1/1986 | Jonas |
| 4,565,295 | A | 1/1986 | Mori et al. |
| 4,666,053 | A | 5/1987 | Corcoran et al. |
| 4,805,792 | A | 2/1989 | Lecinski, Jr. |
| 5,215,204 | A | 6/1993 | Beck et al. |
| 5,246,125 | A | 9/1993 | Julian |
| 5,295,600 | A | 3/1994 | Kowal |
| 5,320,234 | A | 6/1994 | Kamath |
| 5,360,126 | A | 11/1994 | Snyder et al. |
| 5,725,115 | A | 3/1998 | Bosl et al. |
| 5,853,095 | A | 12/1998 | Marshall et al. |
| 6,116,443 | A | 9/2000 | Parrinello |
| 6,372,167 | B1 | 4/2002 | Morini |
| 6,405,886 | B1 | 6/2002 | Gearhart et al. |
| 6,474,491 | B1 | 11/2002 | Benoit-Gonin et al. |
| D593,856 | S | 6/2009 | Kubler |
| 8,469,213 | B2 | 6/2013 | Ishii et al. |
| 8,490,805 | B2 | 7/2013 | Giraud et al. |
| 8,602,234 | B2 | 12/2013 | Hayashi |
| 8,695,822 | B2 | 4/2014 | Kwon |
| 8,720,716 | B2 | 5/2014 | Campbell |
| 9,010,555 | B2 | 4/2015 | Luzzato et al. |
| 9,108,774 | B2 | 8/2015 | Kwon |
| 9,376,243 | B2 | 6/2016 | Cerveny |
| 9,643,762 | B2 | 5/2017 | Maguire |
| 9,776,779 | B2 | 10/2017 | Campbell |
| 9,932,159 | B2 | 4/2018 | Maguire |
| 2003/0071007 | A1 | 4/2003 | Ma et al. |
| 2005/0045578 | A1 | 3/2005 | Schwarz et al. |
| 2009/0236304 | A1 | 9/2009 | Watson |
| 2010/0258520 | A1 | 10/2010 | Giraud et al. |
| 2011/0000137 | A1 | 1/2011 | Druitt et al. |
| 2011/0000871 | A1 | 1/2011 | Bernard et al. |
| 2011/0114593 | A1 | 5/2011 | Ishii et al. |
| 2011/0174760 | A1 | 7/2011 | Luzzato |
| 2012/0024815 | A1 | 2/2012 | Kwon |
| 2012/0285921 | A1 | 11/2012 | Kwon |
| 2013/0001185 | A1 | 1/2013 | Antier et al. |
| 2017/0362003 | A1 | 12/2017 | Maguire |
| 2018/0170625 | A1 | 6/2018 | Sung |
| 2018/0370701 | A1 | 12/2018 | Maguire |
| 2019/0106246 | A1 | 4/2019 | Kendall |
| 2019/0344944 | A1 | 11/2019 | Maguire |
| 2019/0375555 | A1 | 12/2019 | Edie et al. |

FOREIGN PATENT DOCUMENTS

| | | |
|---|---|---|
| CN | 201209040 | 3/2009 |
| CN | 102700823 | 10/2012 |
| DE | 9318243 | 2/1994 |
| FR | 2953202 | 6/2011 |
| JP | 2001019002 | 1/2001 |
| JP | 2004307006 | 11/2004 |
| JP | 2005041566 | 2/2005 |
| JP | 2005289488 | 10/2005 |
| JP | 4906441 | 3/2012 |
| KR | 20-0213792 | 2/2001 |
| KR | 20080093839 | 10/2008 |
| KR | 100872159 | 1/2009 |
| KR | 101744846 | 6/2017 |
| WO | WO2009048273 | 4/2009 |
| WO | WO2019177616 | 9/2019 |

OTHER PUBLICATIONS

Extended European Search Report for Application No. 19800318.8 dated Jan. 5, 2022 (8 pages).

CLOSURE WITH HINGE

CROSS-REFERENCE TO RELATED PATENT APPLICATIONS

This application is a continuation of U.S. application Ser. No. 17/086,951, filed Nov. 2, 2020, which is a continuation of U.S. application Ser. No. 15/974,871, now U.S. Pat. No. 10,836,544, filed May 9, 2018, each of which is incorporated herein by reference in its entirety.

BACKGROUND OF THE INVENTION

The present invention relates generally to a container closure having a hinged configuration that allows the closure to remain coupled to a container after the closure is opened. Specifically, whereas traditional closure plug designs are configured to permanently detach from the container after being opened, the design and configuration of the closure having a hinged configuration illustrated and described herein allows a closure to remain coupled to the container after being opened. As a result, there is a decreased likelihood that the closure may be littered.

SUMMARY OF THE INVENTION

In one embodiment a closure is centered about a vertical axis. The closure comprises a generally circular top panel having an upper surface, a lower surface and an outer periphery. A skirt extends generally perpendicularly downward from the outer periphery of the top panel. A thread is formed about an inner surface of the skirt.

In one embodiment, a closure includes an attachment band that is coupled to the container, and an indicator section that maintains a connection between the attachment band and the closure. When a user opens the closure, the frangible connections in the indicator section are broken, thereby allowing the upper portion of closure to be removed from the container inlet. After the closure is opened the indicator section maintains a connection between the attachment band and the rest of closure. The indicator section includes an attachment channel along which several frangible connections are aligned. The an attachment channel includes at least one bridge connection that remains unbroken after the frangible connections are broken.

In several embodiments, the attachment channel includes two attachment channels. A first attachment channel encircles the periphery of the indicator section, and a second attachment channel extends generally parallel to the primary channel. The first channel includes two bridge connections near either end of the second channel. The second channel covers a subset of the periphery of the indicator section, such as 45 degrees. In one embodiment, the first channel is above the second channel when the container is in an upright orientation. In another embodiment, the first channel is below the second channel when the container is in an upright orientation. In another embodiment, the first channel and the second channel are connected by a diagonal channel.

In one embodiment, the attachment channel encircles the periphery of the indicator section with a helical profile. As a result, the attachment channel covers more than 360 degrees of arc, for example 380-400 degrees of arc. In this example, there are 20-40 degrees of arc with vertical overlap. The vertical distance between the two ends of the attachment channel enable that portion of the indicator section to remain coupled even after the frangible connections are broken, and as a result the closure body remains coupled to the container even after the closure is opened.

In one embodiment, the attachment channel encircles the periphery of the indicator section. The attachment channel includes a plurality of frangible connections that are broken when the closure is opened. The attachment channel further includes two bridge connections, which are larger than the frangible connections and therefore remain unbroken when the frangible connections are broken.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
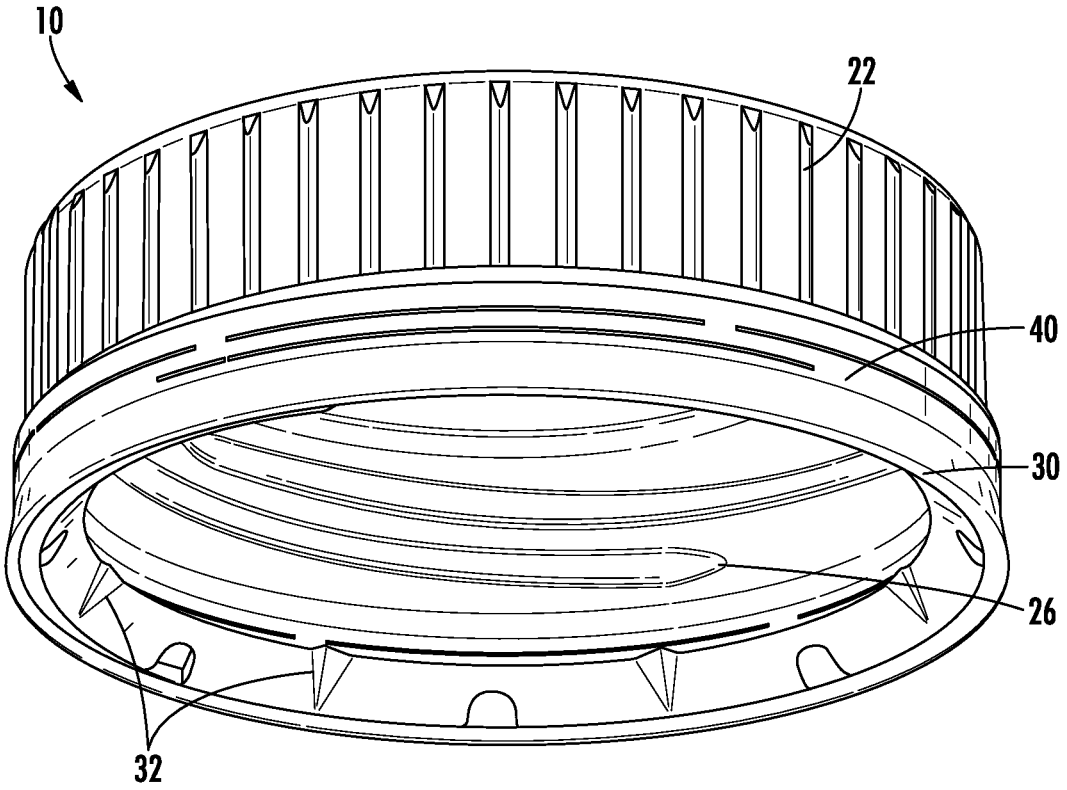
FIG. 1 is a bottom perspective view of a closure according to one embodiment.

Turning to FIG. 1, a closure 10 is shown according to an exemplary embodiment. Closure 10 includes an end wall or top portion, shown as a top panel 12. Top panel 12 is generally circular in shape and is generally planar (i.e., the outer surface of top panel 12 is flat and positioned substantially in a single plane). Closure 10 includes a sidewall, shown as skirt 20, and a transition section, shown as a corner section 18. Corner section 18 extends outwardly and downwardly from the outer, peripheral edge of top panel 12, and skirt 20 extends downwardly from the outer, peripheral edge of corner section 18.

Skirt 20 is generally annular in cross-section and is substantially perpendicular to the plane defined by top panel 12. As shown in FIG. 1, closure 10 may also optionally include a plurality of raised ribs 22 extending radially outward from an outer surface of skirt 20. As shown in FIG. 1, ribs 22 may extend vertically along at least a portion of the vertical length of the outer surface of skirt 14 to provide a textured or gripping surface that may facilitate opening of closure 10.

Figure 2:
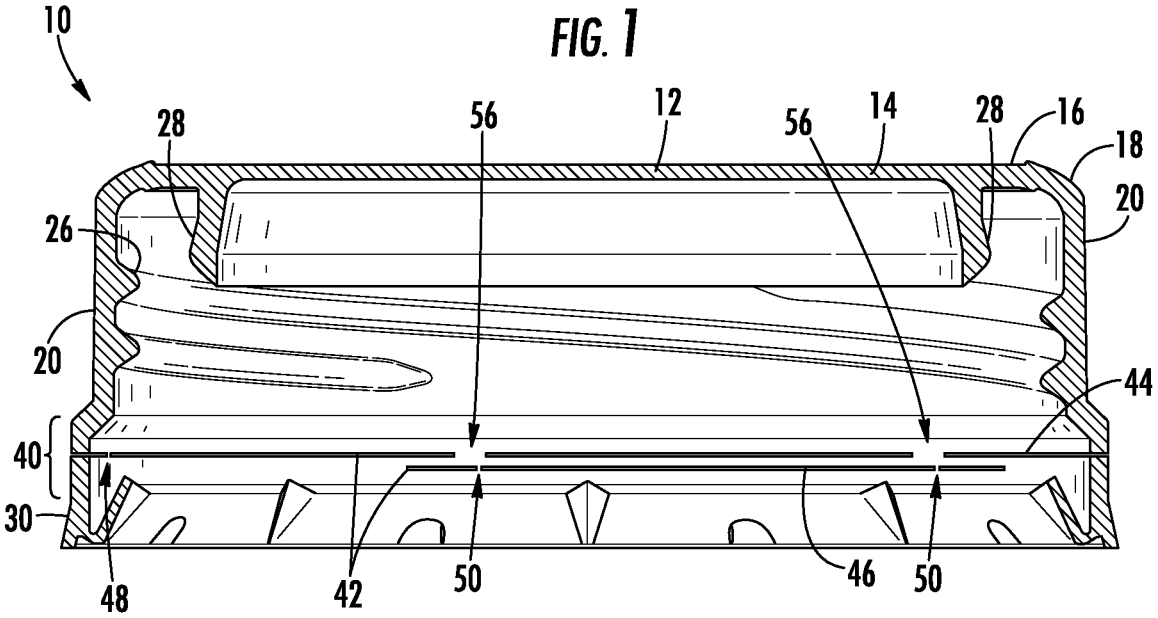
FIG. 2 is a cross-sectional view of the closure of FIG. 1 according to one embodiment.

Located along the inner surface of the skirt 20 is a container engagement structure configured to interact with a corresponding closure engagement structure located on the neck 102 of the container 100 to which closure 10 is to be sealing applied. As shown in FIGS. 1-2, in one embodiment the container engagement structure 26 may comprise threading 26 that extends inwardly from the inner surface of skirt 20. Threading 26 is configured to engage corresponding threading present on the container 100 to which closure 10 is attached. In various other embodiments, closure 10 may include any other number of types of engagement structures, such as but not limited to snap beads, lugs, etc.

In some embodiments, closure 10 may further include a tamper evidencing structure configured to provide indication to a user that the initial sealing engagement between closure 10 and the container 100 has been disrupted as a result of the closure 10 being partially or entirely opened. As shown in FIG. 1-2, in one embodiment the tamper evidencing structure may comprises an attachment band 30 coupled to a lower end of skirt 20 by one or more attachment channels 42 that have a series of frangible connections 48. Upon application of twisting force to closure 10 to remove closure 10 from a container 100, a majority if not all frangible connections 48 are configured to break, separating attachment band 30 from skirt 20 except for an intervening connection, such as hinge bridges 56 illustrated in FIG. 5.

In one or more embodiments, attachment channel 42 includes frangible connections 48, linear openings 54 and one or more hinge bridges 56. Frangible connections 48 each have a width that is less than hinge bridges 56. As a result, hinge bridges 56 are sturdier and more resistant to breaking from torque when closure 10 is being removed from container 100.

Figure 3:
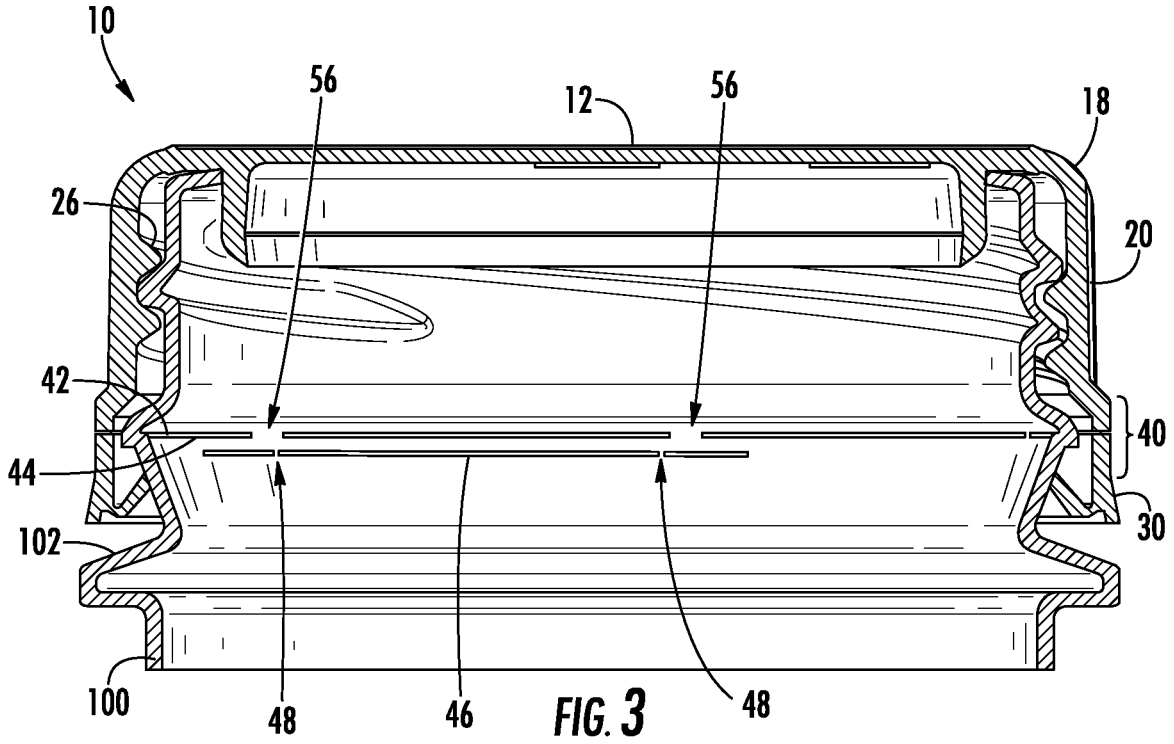
FIG. 3 is a cross-sectional view of a closure of FIG. 1 sealingly applied to a spin-trim neck finish.

As shown in FIGS. 1-3, attachment band 30 may include a plurality of pleats 26 and/or a plurality of curved band sections 28. In general, pleats 26 engage cooperating structures on the neck of the container to prevent closure 10 from being removed from the container without a majority and/or all of frangible connections 48 breaking Further, pleats 26 also facilitate application of closure 10 on to the container by allowing attachment band 30 to expand without breaking frangible connections 48.

Figure 4:
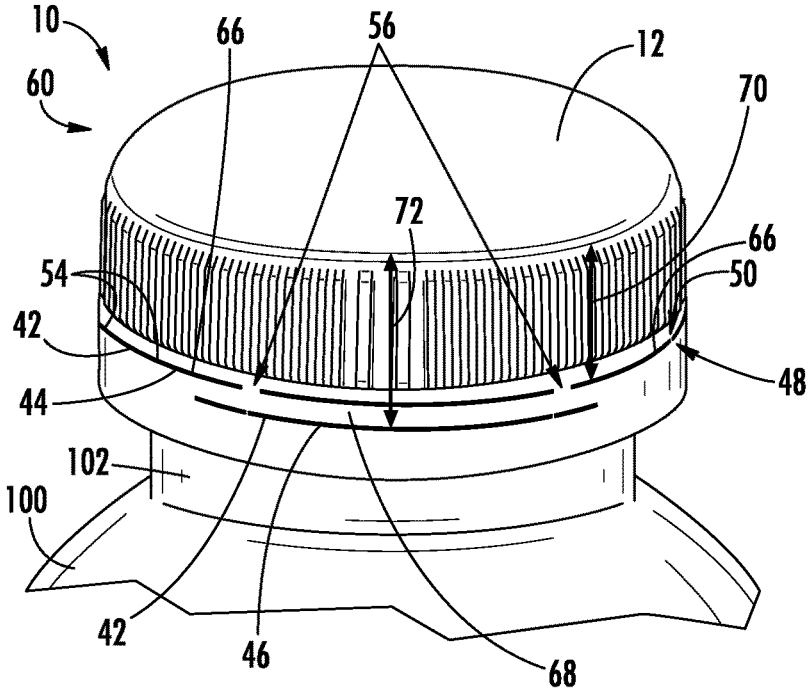
FIG. 4 is a top perspective view of a closure of FIG. 1, before the closure has been opened.
Figure 5:
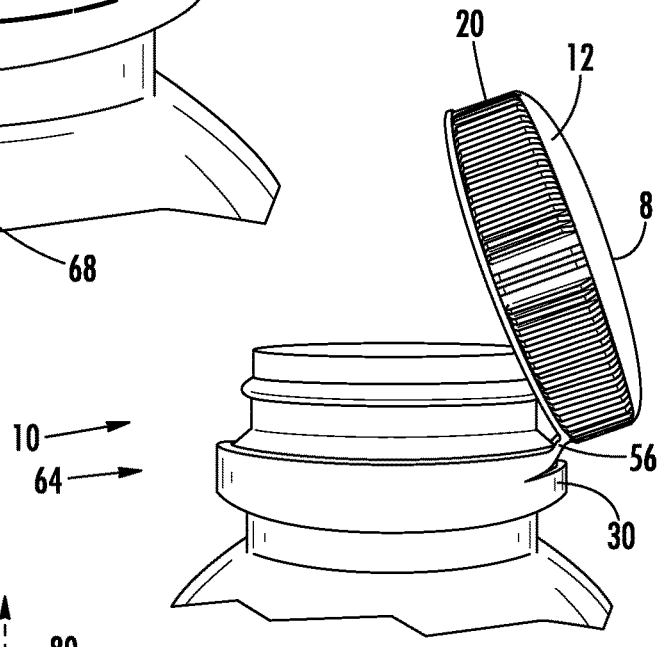
FIG. 5 is a top perspective view of a closure of FIG. 1, when the closure is opened.
Figure 6:
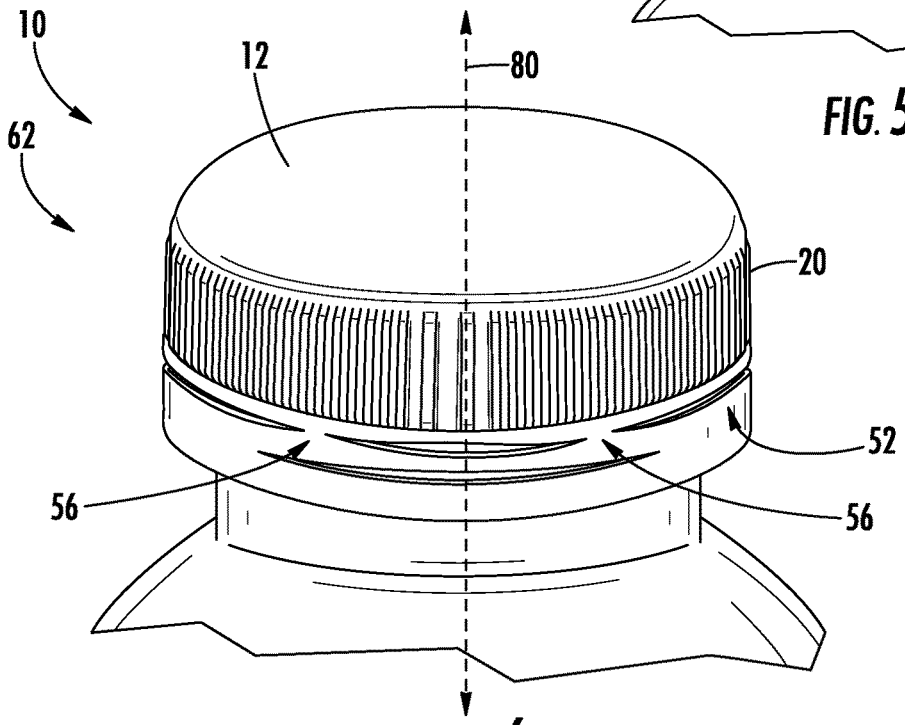
FIG. 6 is a top perspective view of a closure of FIG. 1, after the closure has been opened and subsequently re-attached to the container.

FIGS. 4-6 illustrate alternate views of the embodiment of closure 10 in FIGS. 1-3 in varying configurations of being opened. In FIG. 4, all of frangible connections 48 are unbroken frangible connections 50. In the embodiment in FIGS. 4-6, closure 10 includes indicating section 40, which is located between sidewalls 20 and attachment band 30. Indicating section 40 includes two attachment channels 42, one of which is top channel 44 and one of which is bottom channel 46.

When the container 100 that closure 10 is coupled to is oriented in a typical upright position, top panel 12 is substantially horizontal to a ground surface and sidewalls 20 are generally vertical with respect to the ground. The two attachment channels 42 each include one or more of a plurality of frangible connections 48 that may be broken when closure 10 is removably uncoupled from the container 100. Among the two attachment channels 42 in the embodiment shown in FIGS. 1-6 are top channel 44 and bottom channel 46. Top channel 44 circumferentially surrounds closure 10 at a substantially consistent distance 70 from top panel 12. Bottom channel 46 partially circumferentially surrounds closure 10 a substantially consistent second distance 72 from top panel 12. In this arrangement, top channel 42 and bottom channel 44 are substantially parallel to each other.

In one embodiment, top channel 44 includes a plurality of frangible connections 48 and two hinge bridges 56. Hinge bridges 56 are located approximately 30 degrees of arc from each other from the perspective of center axis 80 of closure 10. Hinge bridges 56 delimit attachment channel 42 into shorter channel 68, which connects hinge bridges 56 via the relatively shorter connecting route, and longer channel 66, which connects hinge bridges 56 by circumferentially encircling closure 10 via the relatively longer connecting route. Frangible connections 48 are disposed periodically throughout top channel 44, such as approximately every 20 degrees of arc from the perspective of center axis 80 of closure 10. A majority of frangible connections 48 are located in longer channel 66. Shorter channel 68 includes one frangible connection 48 in the embodiment of FIG. 4. It is considered that shorter channel 68 and longer channel 66 may each include any number of frangible connections 48.

In use, closure 10 is secured to a container and has a closed configuration 60 (shown in FIG. 4). In this configuration a majority, if not all, of frangible connections 48 are unbroken frangible connections 50, and therefore attachment channel 42 remains generally closed. When a user wants to open closure 10, sidewall 20 with ribs 22 are gripped by the user and rotated (e.g., counter-clockwise from the perspective above closure 10). Pleats 26 engage cooperating structures on the neck of the container 100 to prevent closure 10 from being removed from the container 100 without a majority and/or all of frangible connections 48 breaking As a result, a majority and/or all of frangible connections 48 break, leaving attachment band 30 coupled to the inlet of the container 100.

Hinge bridges 56 are sturdier than frangible connections 48 and therefore less likely to break when closure 10 is being opened. As a result, often hinge bridges 56 remain unbroken and therefore upper portion 8 of closure 10, which includes top panel 12 and sidewall 20, remains coupled to attachment band 30 via hinge bridges 56. At this point, closure 10 has an open configuration 64 in which upper portion 8 is positionable to uncover the inlet of the container 100, and as a result the contents of the container 100 (e.g., water) may be consumed, removed, etc.

Subsequent to a user removing the contents of the container 100, upper portion 8 of closure may be re-coupled to the inlet of the container 100. Sidewall 20 is positioned above container inlet 102 and rotated to engage container engagement structure 26 with the outer surface of the container inlet 102 (e.g., by rotating sidewall clockwise from a perspective above top panel 12).

The embodiment in FIGS. 4-6 includes two attachment channels 42; a top channel 44 and a bottom channel 46. Top channel 44 includes two hinge bridges 56. In the embodiment shown in FIGS. 4-6, bottom channel 46 circumferentially extends beyond hinge bridges 56.

In another embodiment (not shown), one end of bottom channel 46 circumferentially extends to a point that is vertically aligned with the intersection between hinge bridge 56 and longer channel 66. In yet another embodiment (not shown), one end of bottom channel 46 circumferentially extends to a point that is vertically aligned with the intersection between hinge bridge 56 and shorter channel 68. In yet another embodiment (not shown), one end of bottom channel 46 extends to a point that is vertically aligned with hinge bridge 56. In one or more other embodiments, ends of bottom channel 46 may include a combination of one or more dispositions as described in this disclosure.

Figure 7:
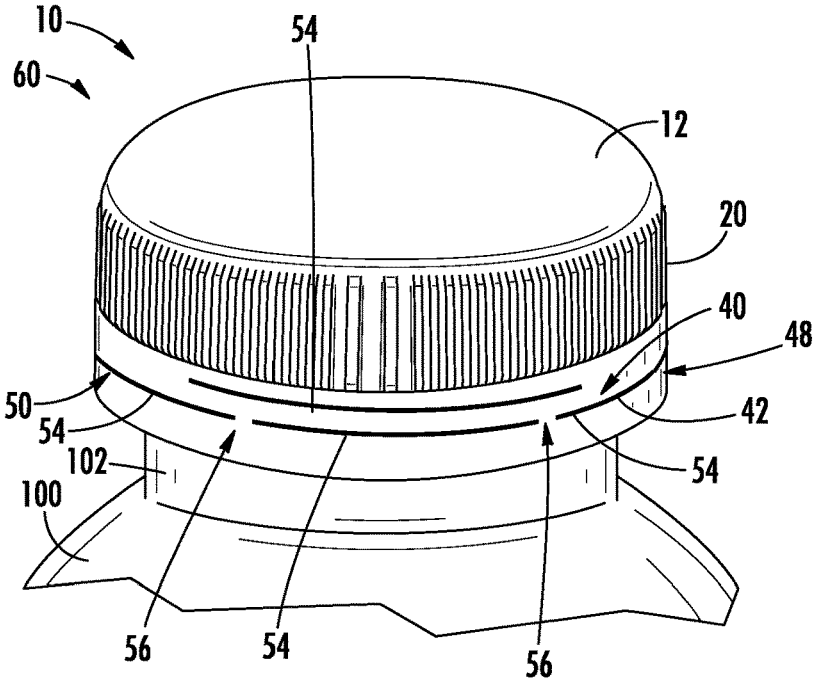
FIG. 7 is a top perspective view of a closure according to one embodiment, before the closure has been opened.
Figure 8:
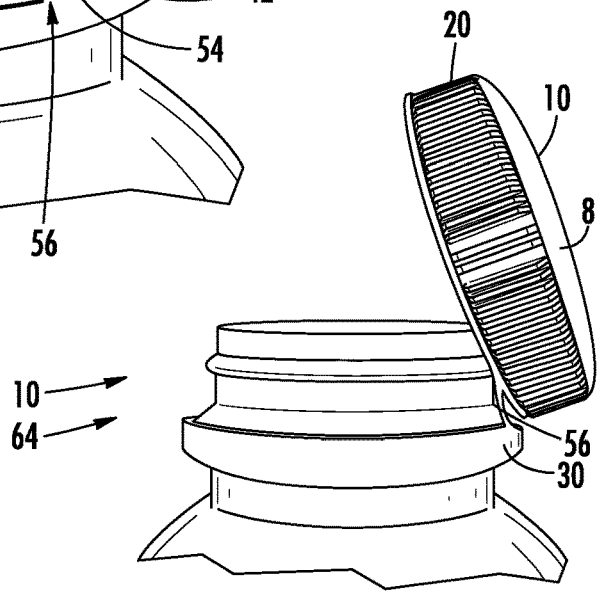
FIG. 8 is a top perspective view of a closure of FIG. 7, when the closure is opened.
Figure 9:
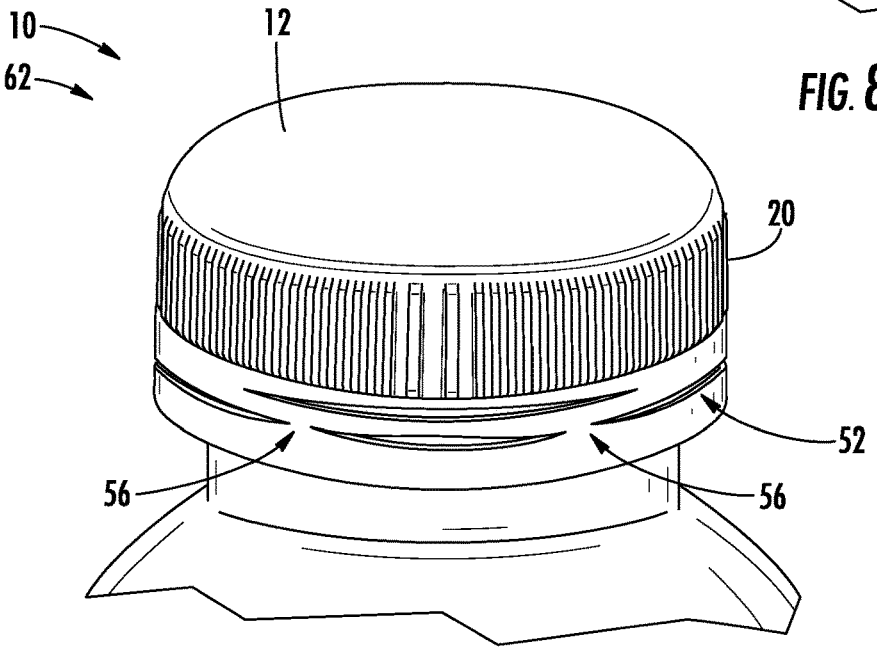
FIG. 9 is a top perspective view of a closure of FIG. 7, after the closure has been opened and subsequently re-attached to the container.

The embodiment in FIGS. 7-9 includes two attachment channels 42: a top channel 44 and a bottom channel 46. Bottom channel 46 includes two hinge bridges 56. In the embodiment shown in FIGS. 7-9, top channel 44 extends past hinge bridges 56. In short, attachment channels 42 in the embodiment of FIGS. 4-6 are similar to and vertically symmetrical with respect to the attachment channels 42 in the embodiment of FIGS. 7-9.

Figure 10:
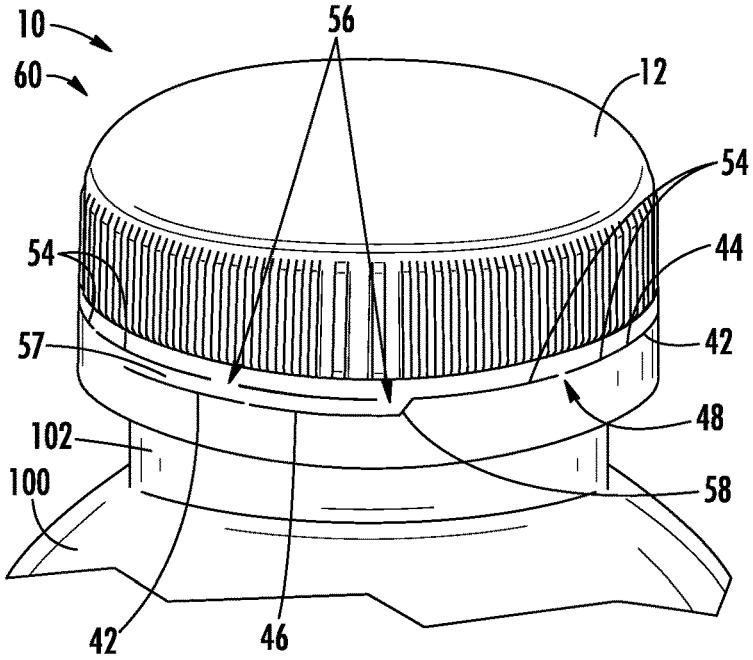
FIG. 10 is a top perspective view of a closure according to one embodiment, before the closure has been opened.
Figure 11:
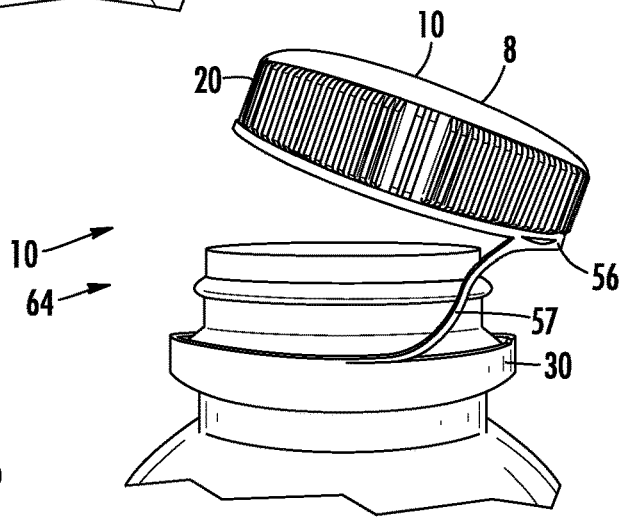
FIG. 11 is a top perspective view of a closure of FIG. 10, when the closure is opened.
Figure 12:
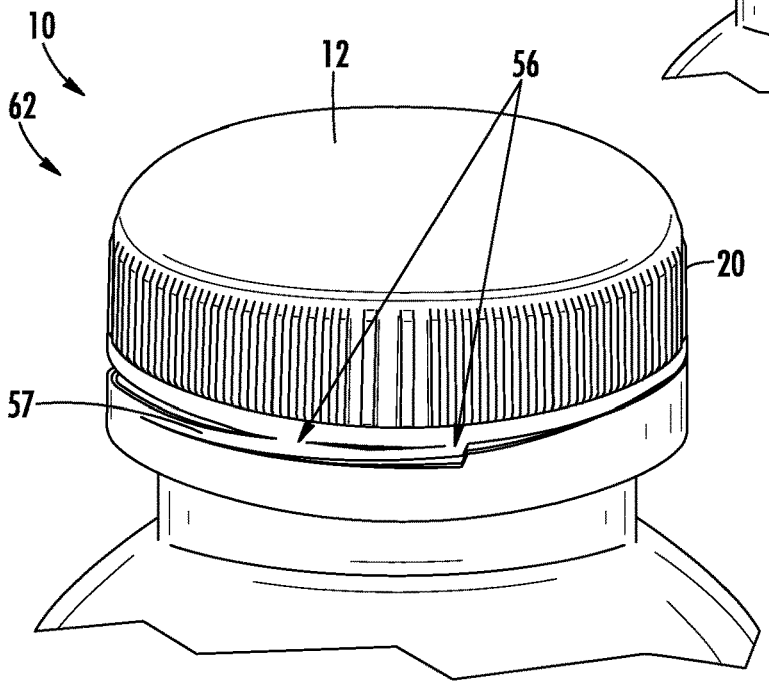
FIG. 12 is a top perspective view of a closure of FIG. 10, after the closure has been opened and subsequently re-attached to the container.

The embodiment in FIGS. 10-12 includes three attachment channels 42; a top channel 44, a bottom channel 46 and a channel connector 58. Top channel 44 and bottom channel 46 are connected by channel connector 58, which in the embodiment shown in FIGS. 10-12 diagonally connects top channel 44 and bottom channel 46. In this embodiment, an end of one of hinge bridges 56 is located at an end of channel connector 58. Subsequent to upper portion 8 being removed from container inlet 102, a majority and/or all of frangible connections 48 break, leaving sidewall 20 connected to attachment band 30 via connecting strand 57 (best shown in FIG. 11).

Figure 13:
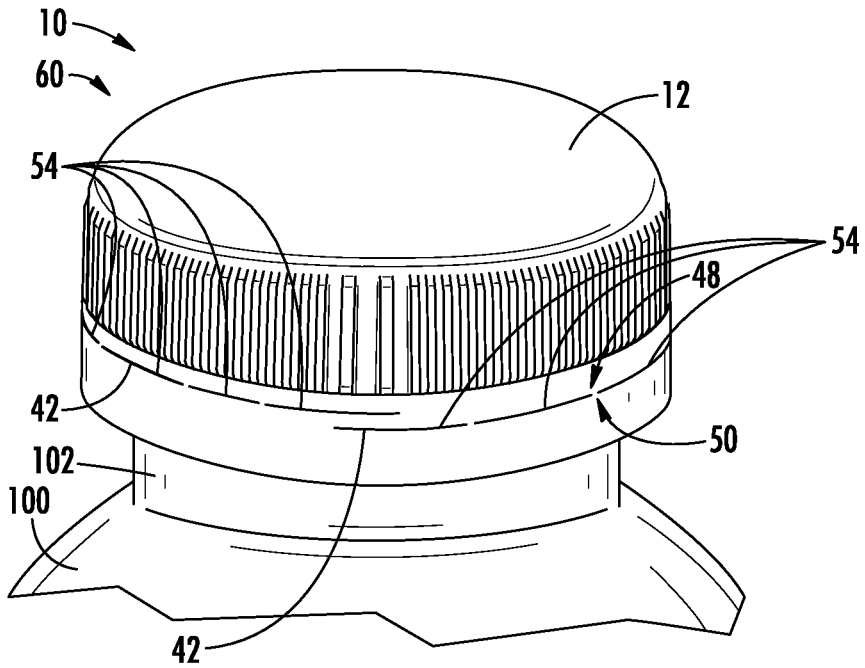
FIG. 13 is a top perspective view of a closure according to one embodiment, before the closure has been opened.
Figure 14:
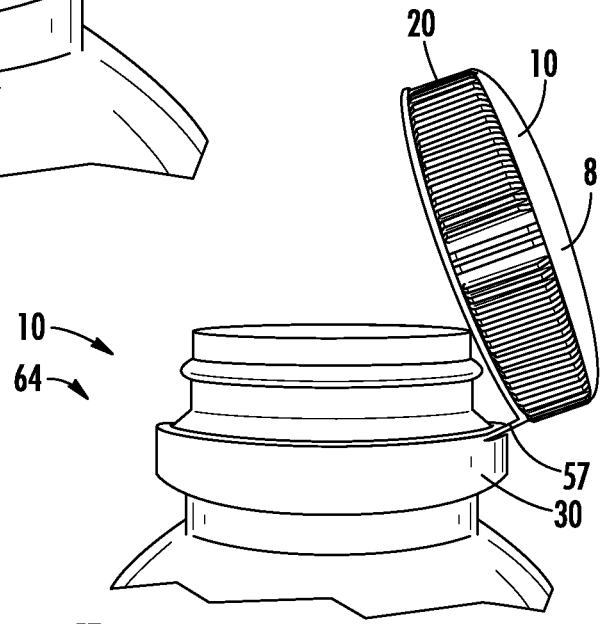
FIG. 14 is a top perspective view of a closure of FIG. 13, when the closure is opened.
Figure 15:
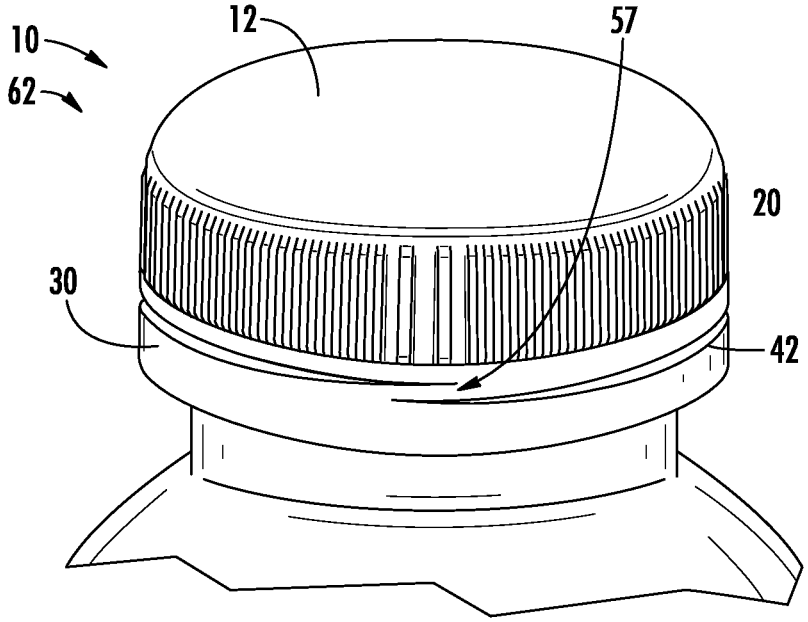
FIG. 15 is a top perspective view of a closure of FIG. 13, after the closure has been opened and subsequently re-attached to the container.

The embodiment in FIGS. 13-15 includes one attachment channel 42. In this embodiment, attachment channel 42 is arranged in a helical profile around indicating section 40 of closure 10. Attachment channel 42 circumferentially extends more than 360 degrees around closure 10 (e.g., 380 degrees). It is contemplated herein that helical attachment channel 42 may arcuately extend any number of degrees around indicating section 40, such as for exemplary purposes only and without limitation, 360 degrees, and/or less than 360 degrees (e.g., 340 degrees, 350 degrees).

Subsequent to upper portion 8 being removed from container inlet, a majority and/or all of frangible connections 58 break, leaving sidewall 20 connected to attachment band 30 via connecting strand 57 (best shown in FIG. 14). This embodiment does not include hinge bridges 56, although various other embodiments including a helical attachment channel 42 also include one or more hinge bridges 56.

Figure 16:
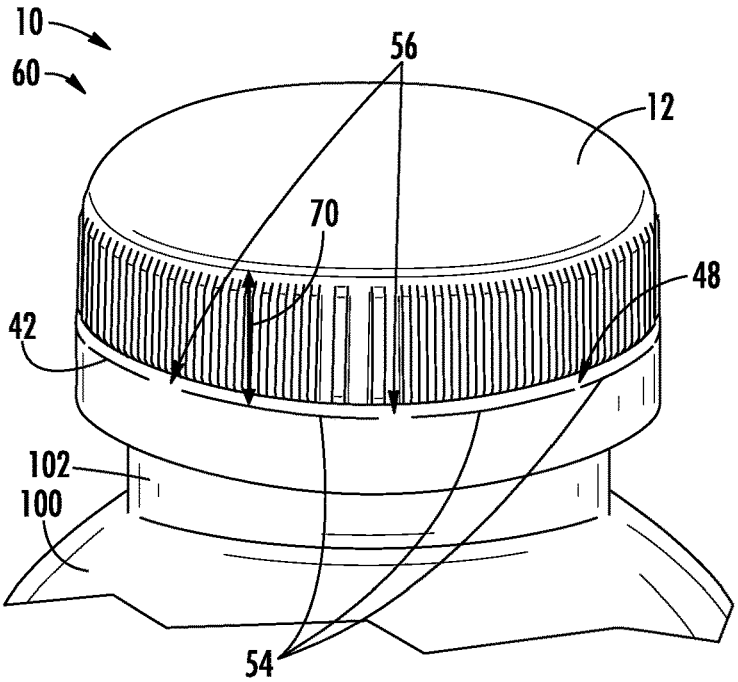
FIG. 16 is a top perspective view of a closure according to one embodiment, before the closure has been opened.
Figure 17:
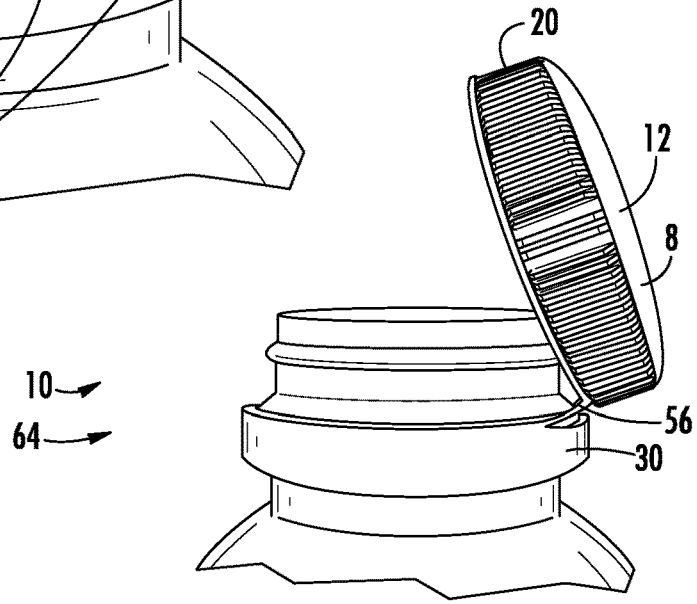
FIG. 17 is a top perspective view of a closure of FIG. 16, when the closure is opened.
Figure 18:
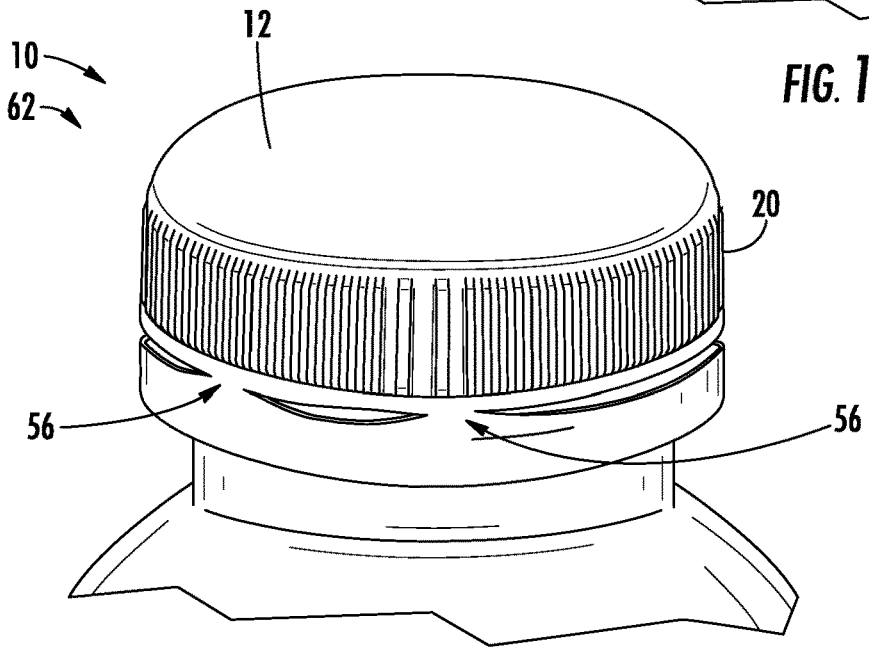
FIG. 18 is a top perspective view of a closure of FIG. 16, after the closure has been opened and subsequently re-attached to the container.

The embodiment in FIGS. 16-18 includes one attachment channel 42 with a generally fixed channel height 70 with respect to top panel 12. Attachment channel 42 circumferentially surrounds closure 10. Subsequent to upper portion 8 being removed from container inlet 102, a majority and/or all of frangible connections 58 break, leaving sidewall 20 connected to attachment band 30 via hinge bridges 56 (best shown in FIG. 17).

The embodiments illustrated in FIGS. 1-6, 7-9, 10-12, 13-15 and 16-18 include attachment channels 42 that are generally straight. Additionally, except for the embodiment illustrated in FIGS. 13- attachment channels 42 are perpendicular to a vertical axis 80 of container 100 as well as closure 10. However, it is contemplated herein that attachment channels 42 may be any shape or arrangement, including without limitation, curved (e.g., a sine curve) and/or zigzagged.

In various embodiments, the closures 10 discussed herein may be of various sizes intended to seal containers of various sizes and having various contents. In some exemplary embodiments, the closures 10 are configured to seal containers such as metal, glass or plastic containers or bottles for holding liquids, granular materials, food, etc. In various embodiments, the angled sealing plug 40 of the closures 10 discussed herein is suitable for maintaining a hermetic seal with the container neck finish to which the closure 10 is attached.

In various embodiments, closure 10 is configured to seal a container configured to hold consumable or edible products (e.g., beverages, water, food, etc.). In various embodiments, closure 10 is configured to seal a container that is a molded (e.g., blow-molded) thermoplastic beverage container configured to hermetically hold a beverage (e.g., water, juice, fortified or nutrient water, tea, sports drink, energy drink, milk, milk-based beverages, etc.). In other embodiments, closure 10 can be used to seal a wide variety of containers including pouches, jars, metal bottles, paper board cartons, etc.

In various embodiments, the closures 10 discussed herein may be formed from a plastic or polymer material. In various embodiments, the closures 10 may be formed by injection molding or by compression molding. For example, the closures 10 may be injection molded from a polypropylene homopolymer resin. In specific embodiments, the closures 10 may be made from a clear (e.g., translucent or transparent) polypropylene homopolymer resin, or they may be made from a clear random copolymer polypropylene. In various embodiments, the clear material of the closure 10 is such that the engagement structure (e.g., threading 20) is visible from the outside of the closure 10 through skirt 14.

In various exemplary embodiments, the relative dimensions, including angles, lengths and radii, as shown in the FIGS. are to scale. Actual measurements of the FIGS. will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

I claim:

1. A closure comprising:

an end wall including an outer peripheral edge;

a sidewall extending downward and away from the outer peripheral edge of the end wall, the sidewall containing an inner surface;

a container engagement structure extending radially inward from the inner surface of the sidewall;

an indicator section including an attachment channel that comprises frangible connections and linear openings between the frangible connections, the frangible connections providing a visual indication, when broken, that the closure has been opened; and an attachment band that remains coupled to a container inlet after the frangible connections are broken, the indicator section maintaining a connection between the sidewall and the attachment band when the frangible connections are broken;

wherein the attachment channel comprises a top channel and a bottom channel, wherein both the top channel and the bottom channel at least partially circumferentially extend around the indicator section, the bottom channel being further from the end wall than the top channel, the bottom channel including at least two hinge bridges that are circumferentially wider than the frangible connections and remain unbroken when the frangible connections are broken, wherein the top channel is between the end wall and at least one of the at least two hinge bridges.

2. The closure of claim 1, the top channel being disposed proximate the at least two hinge bridges and including at least one of the frangible connections.

3. The closure of claim 1, the top channel including at least one of the frangible connections.

4. A closure comprising:

an end wall including an outer peripheral edge;

a sidewall extending downward and away from the outer peripheral edge of the end wall, the sidewall containing an inner surface;

a container engagement structure extending radially inward from the inner surface of the sidewall;

an indicator section including an attachment channel that comprises frangible connections and linear openings between the frangible connections, the frangible connections providing a visual indication, when broken, that the closure has been opened; and an attachment band that remains coupled to a container inlet after the frangible connections are broken, the indicator section maintaining a connection between the sidewall and the attachment band when the frangible connections are broken;

wherein the attachment channel comprises a top channel and a bottom channel, the top channel including at least one of the frangible connections, wherein both the top channel and the bottom channel at least partially circumferentially extend around the indicator section, the bottom channel being further from the end wall than the top channel, the bottom channel including at least two hinge bridges that are circumferentially wider than the frangible connections and remain unbroken when the frangible connections are broken, the bottom channel including at least one of the frangible connections, the top channel including at least one of the frangible connections.

5. The closure of claim 1, wherein the end wall and the sidewall are centered on an axis, and wherein the frangible connections are disposed approximately every 20 degrees of arc apart from each other with respect to the axis.

6. A closure comprising:

an end wall including an outer peripheral edge;

a sidewall extending downward and away from the outer peripheral edge of the end wall, the sidewall containing an inner surface;

a container engagement structure extending radially inward from the inner surface of the sidewall;

an indicator section including an attachment channel that comprises frangible connections and linear openings between the frangible connections, the frangible connections providing a visual indication, when broken, that the closure has been opened; and an attachment band that remains coupled to a container inlet after the frangible connections are broken, the indicator section maintaining a connection between the sidewall and the attachment band when the frangible connections are broken;

wherein the attachment channel comprises a top channel and a bottom channel, wherein both the top channel and the bottom channel at least partially circumferentially extend around the indicator section, the bottom channel being further from the end wall than the top channel, the bottom channel including at least two hinge bridges that are circumferentially wider than the frangible connections and remain unbroken when the frangible connections are broken, the bottom channel including at least one of the frangible connections.

7. The closure of claim 1, wherein the top channel and the bottom channel are substantially parallel to each other.

8. The closure of claim 1, wherein the top channel is between the end wall and at least two of the at least two hinge bridges.

9. A closure comprising:

an end wall including an outer peripheral edge;

a sidewall extending downward and away from the outer peripheral edge of the end wall, the sidewall containing an inner surface;

a container engagement structure extending radially inward from the inner surface of the sidewall;

an attachment band configured to be coupled to a container inlet; and an indicator section that connects the attachment band to the sidewall, the indicator section including an attachment channel with frangible connections, wherein the attachment channel comprises a top channel and a bottom channel, wherein both the top channel and the bottom channel at least partially circumferentially extend around the indicator section, the bottom channel being further from the end wall than the top channel, the bottom channel including at least two hinge bridges that are circumferentially wider than the frangible connections and remain unbroken when the frangible connections are broken, wherein the top channel is between the end wall and at least one of the at least two hinge bridges, the indicator section having two configurations:

an open configuration that provides a visual indication that the closure has been opened as a result of at least a majority of the frangible connections being broken; and a closed configuration that provides an indication that the closure has not been opened.

10. The closure of claim 9, the top channel being disposed proximate the at least two hinge bridges and including at least one of the frangible connections.

11. A closure comprising:

an end wall including an outer peripheral edge;

a sidewall extending downward and away from the outer peripheral edge of the end wall, the sidewall containing an inner surface;

a container engagement structure extending radially inward from the inner surface of the sidewall;

an attachment band configured to be coupled to a container inlet; and an indicator section that connects the attachment band to the sidewall, the indicator section including an attachment channel with frangible connections, wherein the attachment channel comprises a top channel and a bottom channel, wherein both the top channel and the bottom channel at least partially circumferentially extend around the indicator section, the bottom channel being further from the end wall than the top channel, the bottom channel including at least two hinge bridges that are circumferentially wider than the frangible connections and remain unbroken when the frangible connections are broken, the indicator section having two configurations:

an open configuration that provides a visual indication that the closure has been opened as a result of at least a majority of the frangible connections being broken; and a closed configuration that provides an indication that the closure has not been opened, the top channel including at least one of the frangible connections.

12. The closure of claim 11, the bottom channel including at least one of the frangible connections.

13. The closure of claim 9, wherein the end wall and the sidewall are centered on an axis, and wherein the frangible connections are disposed approximately every 20 degrees of arc apart from each other with respect to the axis.

14. The closure of claim 9, wherein the top channel is between the end wall and at least two of the at least two hinge bridges.

15. A closure comprising:

an end wall including an outer peripheral edge;

a sidewall extending downward and away from the outer peripheral edge of the end wall, the sidewall containing an inner surface;

a container engagement structure extending radially inward from the inner surface of the sidewall;

an attachment band configured to be coupled to a container inlet; and an indicator section that connects the attachment band to the sidewall, the indicator section including an attachment channel comprising frangible connections that, when broken, provide a visual indication that the closure has been opened, wherein the attachment channel comprises a top channel and a bottom channel, the top channel including at least one of the frangible connections, wherein both the top channel and the bottom channel at least partially circumferentially extend around the indicator section, the bottom channel being further from the end wall than the top channel, the bottom channel including at least two hinge bridges that are circumferentially wider than the frangible connections and remain unbroken when the frangible connections are broken, each of the top channel and the bottom channel including at least one of the frangible connections;

a plurality of raised ribs extending radially outward from the outer surface of the sidewall and extending along the sidewall at least a portion of a distance between the outer peripheral edge and the indicator section;

wherein the indicator section is configured to maintain a connection between the attachment band and the sidewall when a majority of the frangible connections are broken.

* * * * *